US005465668A

United States Patent [19]

Tarassoff et al.

[11] Patent Number: 5,465,668

[45] Date of Patent: Nov. 14, 1995

[54] OVERHEAD CABLE TRANSPORT INSTALLATION HAVING TWO CABLES

[75] Inventors: Serge Tarassoff; Georges Toyre, both of Seyssinet-Pariset, France

[73] Assignee: Pomagalski S.A., France

[21] Appl. No.: 368,620

[22] Filed: Jan. 4, 1995

[30] Foreign Application Priority Data

Jan. 13, 1994 [FR] France ..... 94 00558

[51] Int. Cl.[6] ..... B61B 7/02

[52] U.S. Cl. ..... 104/95; 104/112; 104/173.1; 105/154

[58] Field of Search ..... 104/94, 95, 112, 104/173.1; 105/154, 155, 149.1

[56] References Cited

U.S. PATENT DOCUMENTS

| | | | |
|---|---|---|---|
| 3,871,303 | 3/1975 | Woodling . | |
| 4,092,929 | 6/1978 | Laurent | 104/173.1 |
| 4,473,011 | 9/1984 | Wuschek | 104/112 X |
| 4,509,430 | 4/1985 | Criessels | 104/112 X |

FOREIGN PATENT DOCUMENTS

| | | |
|---|---|---|
| 983877 | 6/1951 | France . |
| 59966 | 9/1954 | France . |
| 2337067 | 7/1977 | France . |
| 2575985 | 7/1986 | France . |
| 2656340 | 12/1976 | Germany . |

*Primary Examiner*—Robert J. Oberleitner
*Assistant Examiner*—S. Joseph Morano
*Attorney, Agent, or Firm*—Parkhurst, Wendel & Rossi

[57] ABSTRACT

A passenger transport installation in urban aeras comprises a wide track, constituted by two parallel, laterally spaced track cables and vehicles having supporting wheels for running on that track cables. The supporting wheels are located above the vehicle roof at a small constant distance thereof, so as to provide a clearance between the vehicle roof and the horizontal plane containing the track cables, wherein are housed the track cable bearing shoes and the vehicle traction cable loops with their return wheels.

6 Claims, 5 Drawing Sheets

OVERHEAD CABLE TRANSPORT INSTALLATION HAVING TWO CABLES

BACKGROUND OF THE INVENTION

1. Field of the Invention

The invention relates to a passenger transport installation making use of independent passive vehicles hauled along a track by traction cables. The vehicles run on a wide cableway track constituted by two laterally spaced, parallel track cables, which extend, at the same height, above the roof of the vehicle. The distance between the two track cables is substantially equal to, or a little smaller than, the width of the vehicle. Each vehicle comprises running wheels located above the roof, which run on the track cables.

2. Description of the Prior Art

In previous passenger transport installations the vehicle has a carriage which runs on the track cables and a suspension which is situated in the vertical symmetry plane of the two track cables. The upper end of the suspension is fixed by means of a pivot bolt to the carriage and the lower end is fixed to the roof of the vehicle, so that the installation may be installed in difficult mountainous terrain where large inclinations of the track are required. The free-hanging vehicle ensures a constant vertical position for the vehicle, whether the track cable is horizontal or inclined. The length of the suspension is large to permit the free-swinging of the vehicle and the known installations are voluminous and complicated and are not adapted for urban or intercity transportation.

Another known transportation system comprises two track cables, a track cable being on each side of the vehicle, and the vehicle is coupled by a fixed grip to a traction cable located above the vehicle roof. The vehicle is hauled up and down on the track by the traction cable. This shuttle system has a limited transport capacity.

The invention is based on the appreciation that it is desirable to provide an overhead cable installation acceptable for general use in urban areas. The cableway should have a relative light supporting structure and a large transport capacity.

SUMMARY OF THE INVENTION

The installation according to the invention is characterized in that the clearance between the roof of the vehicle and the horizontal plane containing the two track cables is constant and small, for instance about 1 meter. This clearance is adapted for the free passage of the vehicle along the track cable bearing shoes and the traction cable support and drive mechanisms. At least two laterally-spaced, parallel traction cables are arranged in the longitudinal conveying direction inside this small clearance. The traction cables are located between the two track cables and the vehicle is coupled to a traction cable by means of a detachable grip.

In urban aeras the track is substantially horizontal and small inclinations of the vehicle on inclined track sections are acceptable, a long pivotally mounted suspension is not necessary and the height of the track supporting structure, may thus been reduced. The vehicles run on the track cables as railroad cars hauled by traction cables and the track is supported by towers.

The suspension links, between the supporting wheels and the vehicle, extend advantageously outside the track cables and the track cable bearing shoes are secured to inner arms of a one-tower support. An inverted system having suspension links located inside the track cables may be used. Each traction cable passes in the stations over return wheels to form an endless loop and a drive motor rotates one of these return wheels to propel the cable loop and to move the vehicle from one station to the other. At the station the traction cable and the vehicle coupled to this traction cable are stopped for loading and unloading the passengers and the vehicle is uncoupled from the traction cable and coupled to the traction cable of the successive track section. The speed variations of the traction cable are determined by a control apparatus connected to the motor, which provides the acceleration, the high speed drive, the deceleration and the stopping of the vehicle. A traction cable loop extends between two successive stations and in each station the detachable grip is actuated to operate the uncoupling from the traction cable and the coupling to the successive cable. The traction cable ends are transversely spaced and they overlap in the standstill zone of the vehicles in the stations. One cable loop may extend between several successive stations and this cable loop is then stopped at each passage of the vehicle in a station, the uncoupling being only operated in the stations having a traction cable return wheel. Each vehicle comprises a detachable grip, mounted above the roof of the vehicle and that grip is advantageously of the kind described in U.S. Pat. No. 4,092,929 to which reference may be readily had.

The return wheels and the drive mechanisms of the traction cables are advantageously located inside the clearance between the track cables and the vehicle roof, so that the station may be simplified and for instance supported by towers. The traction cable drive wheel may be located in a station where the vehicles are stopped, without uncoupling from the traction cable.

A track section comprises advantageously a plurality of traction cables or cable loops, each driven by a motor, for hauling a plurality, independent vehicles simultaneously along this track section, for instance such as described in the U.S. patent application Ser. No. 08/183,934, filed on Jan. 21, 1994. Each traction cable loop has a traction strand and a return strand and according to an embodiment of the invention all traction strands of a track section are grouped in a first horizontal sheet, while the return strands are grouped in a second horizontal sheet, symmetricaly located with respect to the longitudinal track axis. If the installation comprises two parallel tracks, whereon the vehicles run in opposite directions, the traction strands of the cable loops are associated with one track and the return strands with the other track.

DESCRIPTION OF THE PREFERRED EMBODIMENT

The invention will be further described, by way of example, with reference to the accompanying drawings, in which.

Figure 1:
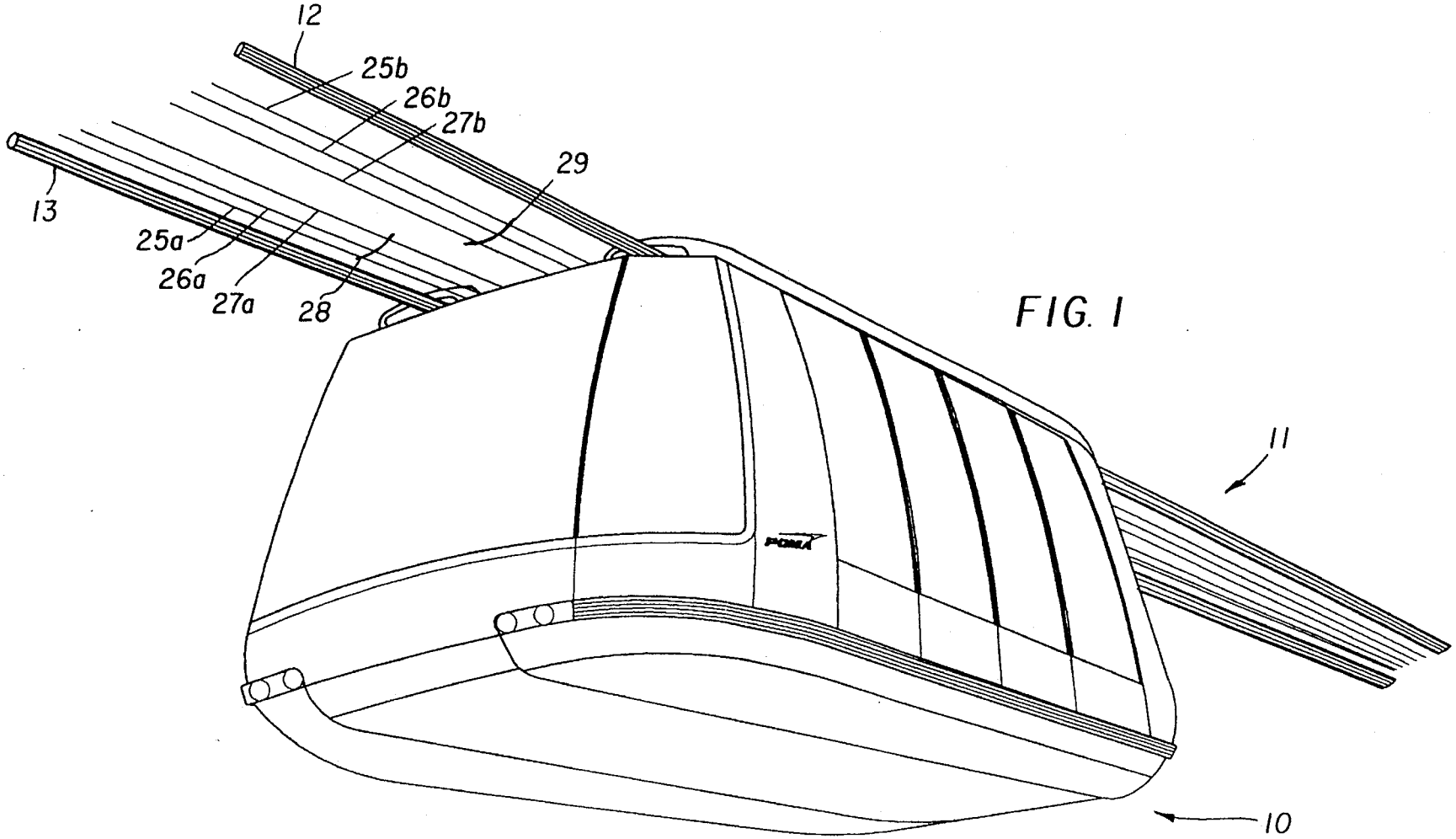
FIG. 1 is a schematic, perspective view of a vehicle of a transport installation in accordance with the invention.

The uncouplable, circulating aerial cableway is for transporting passengers, particularly in urban aeras. Each vehicle 10 has supporting wheels 18 which run along a track 11 constituted by two laterally spaced, parallel track cables 12,13 extending at the same height above the roof 21 of the vehicle 10. There are conventional supports such as towers 22 (see FIGS. 4–6 ) for supporting the track cables 12,13. The distance between the two laterally spaced track cables 12,13 is a little smaller than the width of the vehicle 10 or corresponds substantially to this width, so as to provide a wide track 11 which extends between two or more successive stations, where the vehicles 10 are stopped for loading and unloading of the passengers. The two lateral side walls 14,15 of the vehicle 10, parallel to the track direction 11, are extended upward to form two flanges 16,17 surrounding the two track cables 12,13. Two horizontal axes 19,20 are mounted, at right angles to the direction of travel, on each flange 16,17, near the front and the rear side of the vehicle 10, and a rocking bar with two supporting wheels 18 is pivotally mounted on each axis 19,20. It will be noted that each flange 16,17 may support more than two rocking bars and that the flanges 16,17, which act as vehicle support links, may be constituted by conventional suspension bars. The height "h" of the space or clearance "i" between the vehicle roof 21 and the supporting wheels 18 is constant and small, so that the roof 21 is near the horizontal plane containing the two track cables 12,13, for instance about or less than 1 meter. The length "m" of the vehicle 10 is for instance about 6 meters. Each tower 22 comprises track cable bearing shoes 23 housed in the clearance "i", so that the vehicle 10, running on the track 11, can pass freely. The two bearing shoes 23 are rigidly secured to the one-tower support 22 by means of two transverse beams 24, located inside the track 11, but an alternative realization wherein the transverse beams extend outside the track and the wheels are supported from the inner side, is possible. The vehicle 10 is a passive vehicle hauled by a traction cable.

Three traction cable loops 25,26,27, each having a traction strand 25*a*, 26*a*, 27*a* and a return strand 25*b*, 26*b*, 27*b*, extend inside the clearance "i" above the vehicle roof 21. The traction strands 25*a*, 26*a*, 27*a* are grouped in a first horizontal sheet 28 and the return strands 25*b*, 26*b*, 27*b* in a second horizontal sheet 29, symmetrical with respect to the longitudinal axis of the track 11. The traction cable loops 25,26,27 are disposed between the two track cables 12,13 and they run in a closed circuit between two stations, where they pass over vertical spindle return wheels 32,33, one 32 of which being driven by a motor 34. The traction cables 25,26,27 pass in a well known manner, over support rollers 30 rotatably mounted on a transverse beam 31 secured to the track cables 12,13.

The vehicle 10 comprises a detachable grip 35 for coupling the vehicle to one of the traction strands 25*a*, 26*a*, 27*a* and for hauling the vehicle on the track 11. The grip 35 is for instance of the kind disclosed in the U.S. Pat. No. 4,092,929. While the vehicle 10 is stopped in the station, the grip 35 is closed to couple the vehicle to the stopped traction cable 27*a*, which is then accelerated for hauling the vehicle to the next station, where the traction cable 27*a* and the vehicle 10 are stopped. The passengers of the vehicle can step out or enter and the grip 35 is actuated for transferring the drive from the traction cable of this track section to the traction cable of the successive section. The traction cable ends are transversely spaced and overlap in the standstill zone of the vehicles in the stations so that the grip 35 may be selectively coupled to anyone of these traction cables 25,26,27, while the vehicle remains stationary. The grip 35 is mounted on a transverse cantilever support, which overlaps one track cable 13 and is secured to a flange 17.

It will be seen that the same track section is equipped with three independent traction cable loops 25,26,27, and that it is possible to haul three independent vehicles 10 simultaneously along this track section, to increase the transport capacity, so as disclosed in above mentioned patent application. The track section may have only one or a greater number of traction cables.

Figure 5:
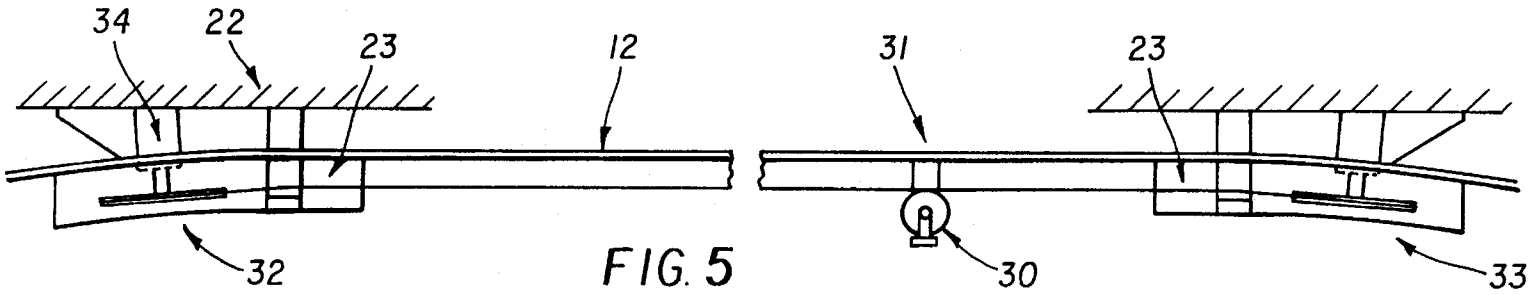
FIGS. 4 and 5 are respectively a plane and an elevational view of a track section equipped with one traction cable loop.
Figure 4:
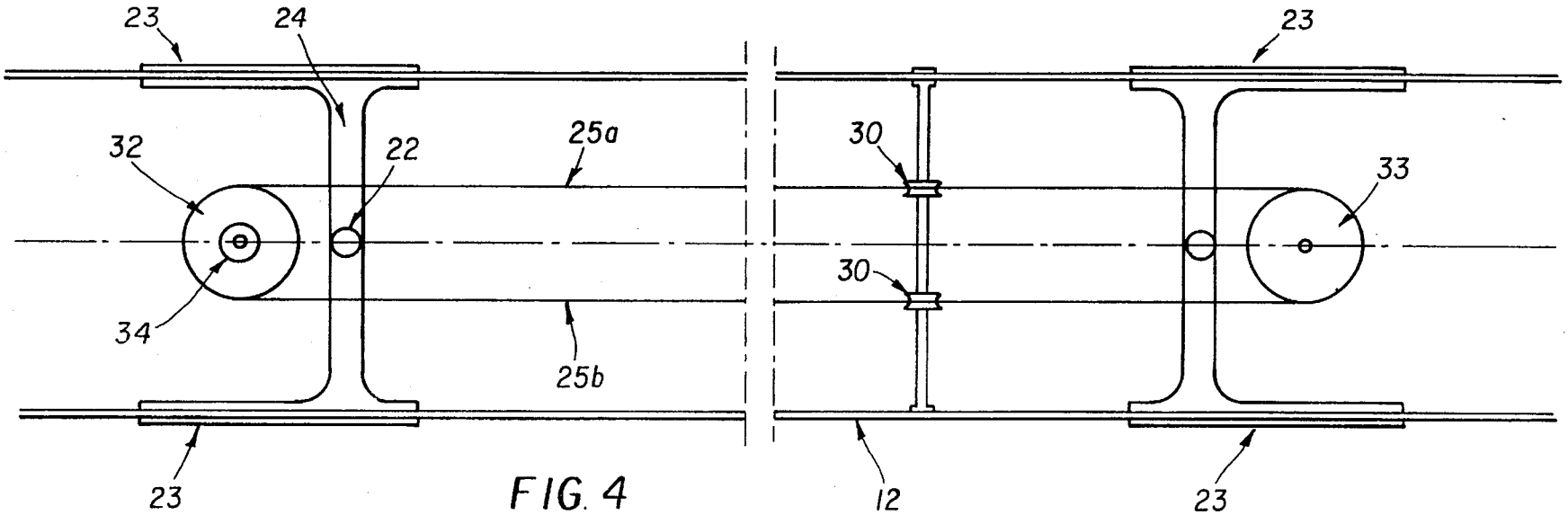
Figure 6:
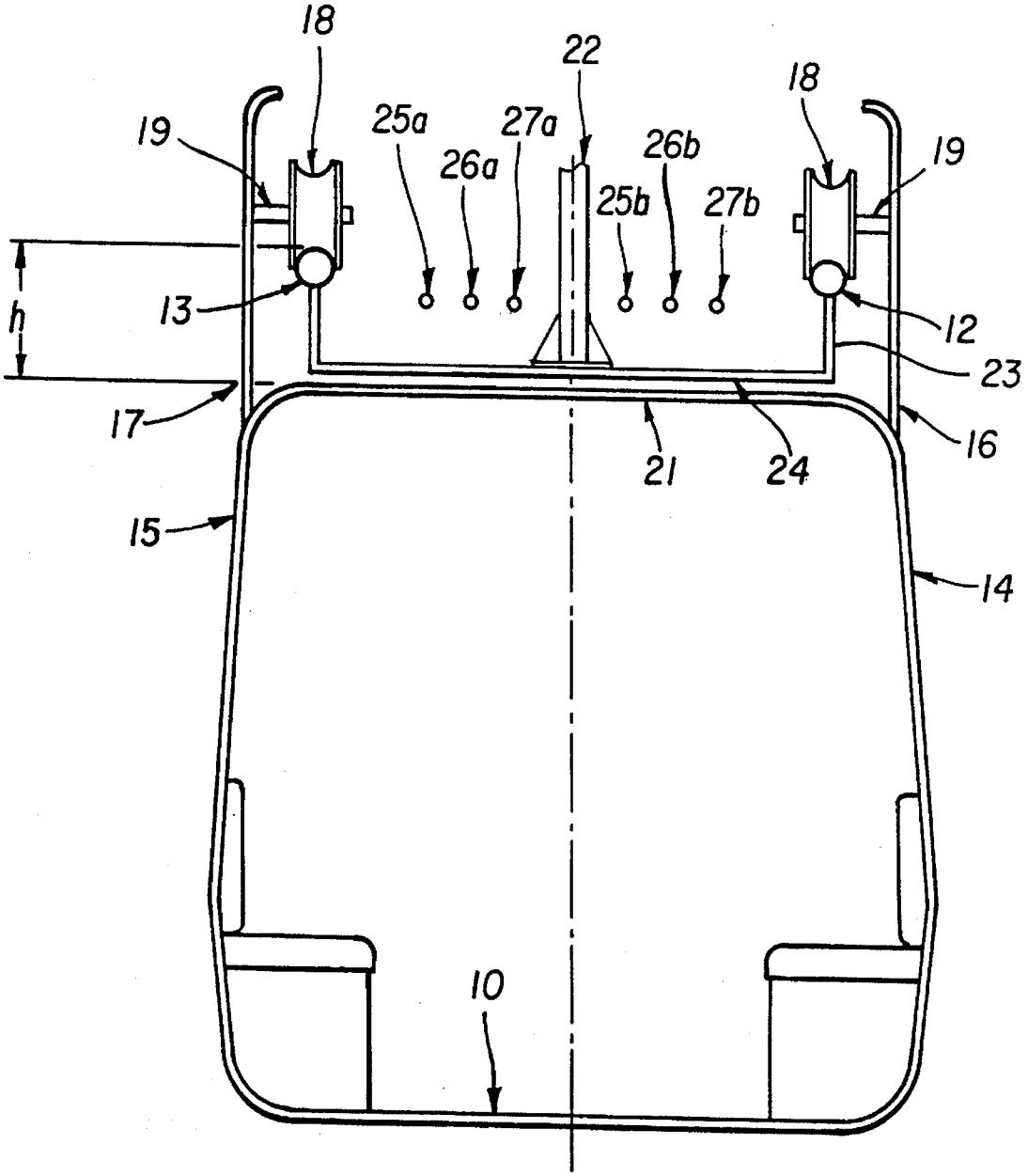
FIG. 6 is a transversal sectional view of the vehicle at the passage of a tower.

The wide track 11 provides a good lateral vehicle stability and enough space for housing the two traction cable sheets 28,29 between the two track cables 12,13. The clearance "i" between the vehicle roof 21 and the track cables 12,13 provides enough space for housing the track cable bearing shoes 23 and the traction cables 25,26,27 with their support rollers 30 and return wheels 32,33 (FIGS.4 and 5). The drive motor 34 is disposed inside or slightly above the clearance "i" and the arrangement provides for free passage of the vehicles and does not require a station building or volimunous support structures for supporting the return wheels with their drive mechanisms.

Figure 2:
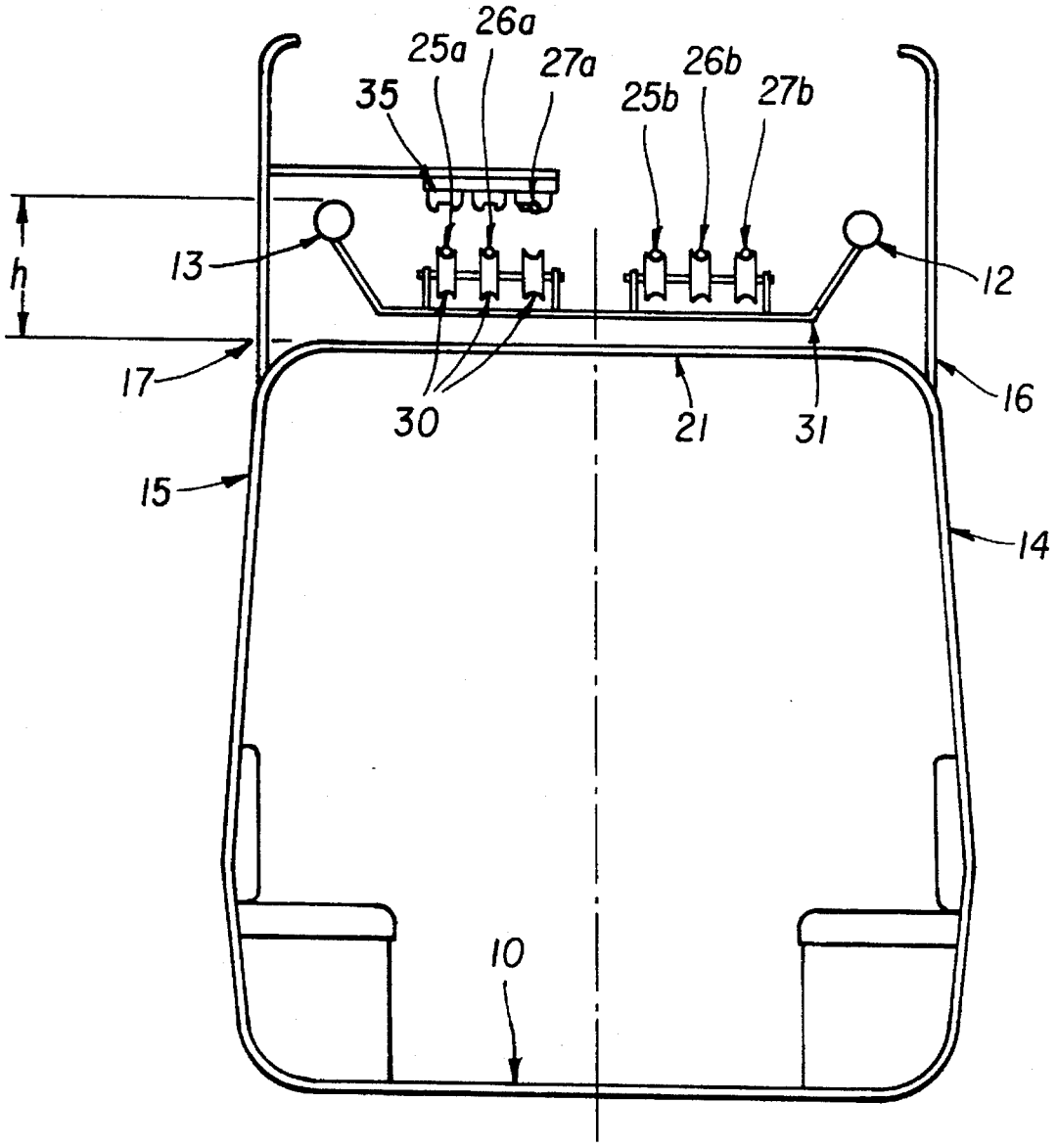
FIGS. 2 and 3 are respectively a transversal and a longitudinal sectional view of the vehicle.
Figure 3:
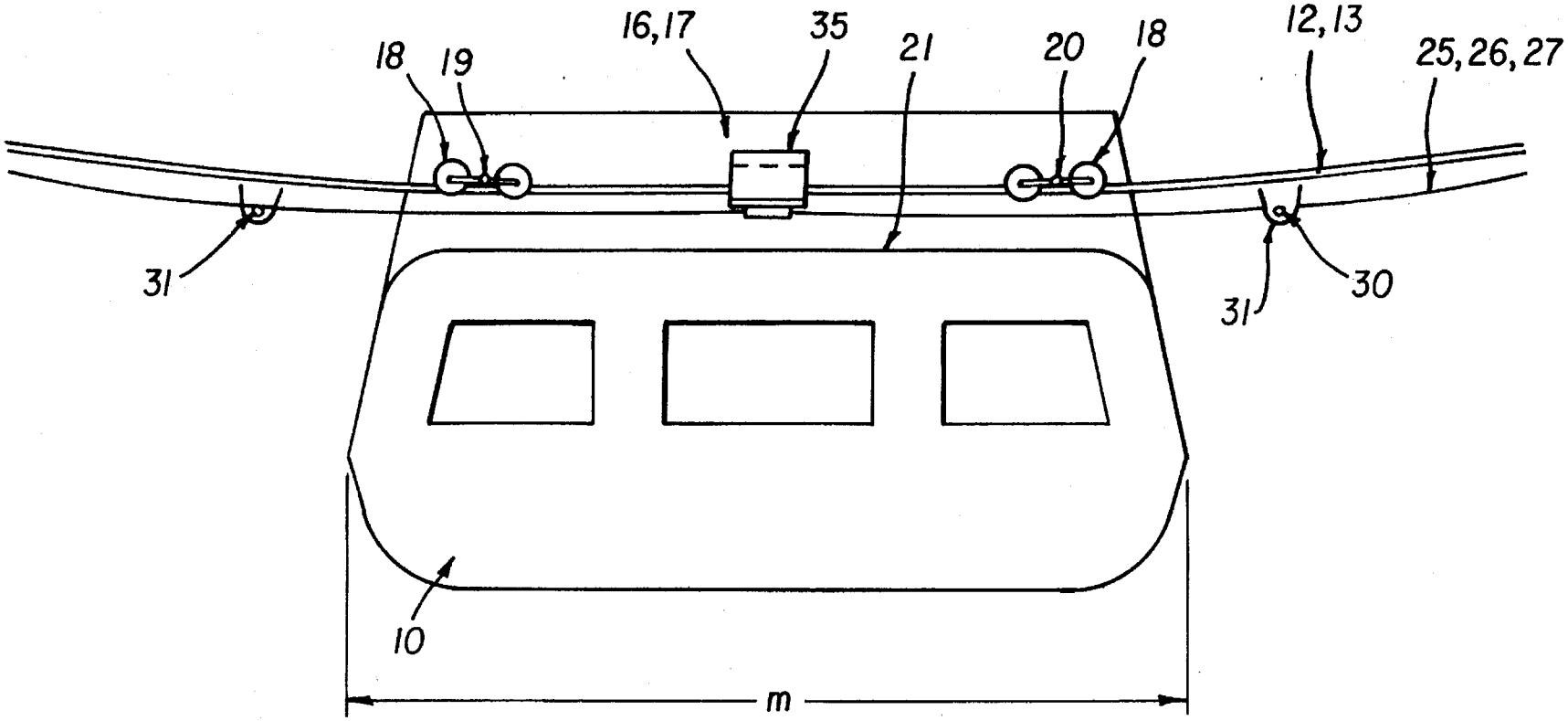

The transferring of the drive of the vehicles from one traction cable to another is actuated while the vehicles are stopped in a station. This transferring does not occur in each station, when a traction cable loop extends along several stations, but only in the stations having traction cable return wheels. The traction cable drive wheel may be independent from the return wheels and for instance, be located in an intermediary station where the vehicles are only stopped. The track may be equipped with one or more traction cable loops and the two strands of each cable loop are advantageously disposed in the same horizontal plane, between the two track cables, as shown in FIG.2. When the installation comprises two adjacent lines of outward and return journey, one strand extends along the outward line and the other strand along the return line.

What is claimed is:

1. An overhead passenger transport installation comprising at least one independent passive vehicle each having a vehicle roof and side walls, a track whereon the vehicle runs, successive stations located along the track, traction cables for driving the vehicle which runs on the track, coupling means in the form of a detachable grip fixed on the vehicle above the vehicle roof and capable of coupling and uncoupling the vehicle onto and from the traction cables for driving the vehicle from one said station to another said station and for stopping the vehicle in the stations, where the vehicle is uncoupled from the traction cables, said track comprising two laterally spaced, parallel track cables extending at the same height between the stations and track cable bearing shoes, each vehicle having supporting wheels running on the track cables and fixed to the vehicle above the vehicle roof so as to provide a clearance between the horizontal plane containing the track cables and the vehicle roof, said clearance having a constant height adapted for housing therein the track cable bearing shoes and the traction cables, between the two track cables.

2. A transport installation according to claim 1, wherein the distance between the two track cables substantially corresponds to the width of the vehicle.

3. A transport installation according to claim 1, wherein the vehicle comprises two flanges surrounding the two track cables, each flange being constituted by an upward extension of the vehicle side wall, and at least two horizontal axes mounted at right angles to the direction of the track on each flange and supporting the vehicle support wheels.

4. A transport installation according to claim 1 having traction cable return wheels located in the stations, to constitute traction cable loops, each loop having a traction strand and a return strand, the cable loop traction strands extending in a first horizontal plane and the cable loop return strands extending in a second horizontal plane inside said clearance such that said cable loop traction strands and said cable loop return strands are symmetrically arranged with respect to the longitudinal axis of the track.

5. A transport installation according to claim 4, wherein the traction cable return wheels are located inside said clearance when said vehicle passes by.

6. A transport installation according to claim 1, wherein the track comprises at least two independent said traction cable loops for hauling at least two independent said vehicles on said track.

* * * * *